US007160182B2

(12) United States Patent
Coe

(10) Patent No.: US 7,160,182 B2
(45) Date of Patent: Jan. 9, 2007

(54) SUPPORT FOR SANDING APPARATUS

(75) Inventor: Andrew Coe, Gateshead (GB)

(73) Assignee: Black & Decker Inc., Newark, DE (US)

( * ) Notice: Subject to any disclaimer, the term of this patent is extended or adjusted under 35 U.S.C. 154(b) by 38 days.

(21) Appl. No.: 11/302,108

(22) Filed: Dec. 13, 2005

(65) Prior Publication Data

US 2006/0128287 A1 Jun. 15, 2006

(30) Foreign Application Priority Data

Dec. 15, 2004 (EP) ..... 04257776

(51) Int. Cl.
*B24B 41/00* (2006.01)

(52) U.S. Cl. ..... 451/360; 451/310; 451/296

(58) Field of Classification Search ..... 451/296, 451/310, 355, 363, 304, 340
See application file for complete search history.

(56) References Cited

U.S. PATENT DOCUMENTS 6,471,568 B1 * 10/2002 Wang ..... 451/168
6,592,440 B1 * 7/2003 Mueller ..... 451/355
6,733,372 B1 * 5/2004 Lin ..... 451/65
2005/0079810 A1 * 4/2005 Melvin et al. ..... 451/360

* cited by examiner

*Primary Examiner*—Lee D. Wilson
*Assistant Examiner*—Anthony Ojini
(74) *Attorney, Agent, or Firm*—Bruce S. Shapiro; John Yun; Wesley W. Muller

(57) ABSTRACT

A support stand (2) for a sanding apparatus having a housing, a motor, and a sanding belt of abrasive material adapted to be driven around a plurality of rollers by means of the motor is disclosed. The support stand (2) comprises a body portion (6) having recesses (10, 14, 18, 22) for engaging corresponding parts of the sanding apparatus to expose the sanding belt of the sanding apparatus, and a control knob (26) mounted to the body portion (6) to be accessible by a user's hand when the sanding apparatus is supported on the support stand (2). The support stand also has a wheel (36) having a friction belt (38) for engaging a belt speed adjustment knob of the sanding apparatus to enable adjustment of the speed of the sanding belt of the sanding apparatus in response to rotation of the control knob (26) in order to control the rate of removal of material by the sander.

13 Claims, 12 Drawing Sheets

SUPPORT FOR SANDING APPARATUS

FIELD OF THE INVENTION

The present invention relates to a support for a sanding apparatus, and relates particularly, but not exclusively, to a support for a belt sander having an endless sanding belt.

BACKGROUND OF THE INVENTION

Belt sanders are known in which an endless abrasive sanding belt passes around a driven roller and a driving roller, and a motor causes the driving roller to rotate to cause the sanding belt to travel over a sanding surface. Such sanders are intended primarily for high stock removal sanding work over large areas such as when sanding wooden floors. However, it is often desirable to clamp the sander in an inverted position so that a user may bring a workpiece into contact with the moving sanding belt, usually for high precision sanding work, such as sanding intricately shaped or delicate workpieces.

It is known to clamp a belt sander in an inverted orientation for this purpose. However, such arrangements suffer from the drawback that when the sander is clamped in an inverted orientation, any switch for controlling the speed of movement of the sanding belt of the sander is inaccessible to the user, making it impossible to control the speed of material removal during the sanding operation. This is a significant drawback in the case of precision sanding operations where there is a risk of damaging the workpiece.

Preferred embodiments of the present invention seek to overcome the above disadvantages of the prior art.

BRIEF SUMMARY OF THE INVENTION

According to the present invention, there is provided a support stand for a sanding apparatus, which sanding apparatus has a housing, a motor, and a plurality of rollers around which a sanding belt of abrasive material may be driven by means of said motor, the support stand comprising:

- a body portion having at least one recess and/or protrusion for engaging a respective corresponding protrusion and/or recess part of the sanding apparatus in order to mount the sanding apparatus and to expose the sanding belt thereof;
- a manually operable adjustment member mounted to said body portion and adapted to be accessible by a user when the sanding apparatus is mounted on the support stand; and
- an engaging member for engaging a motor speed adjustment member of the sanding apparatus to enable adjustment of the speed of the motor and, hence, the speed of the sanding belt of the sanding apparatus in response to actuation of the manually operable adjustment member.

By providing a manually operable adjustment member on the body portion such that the adjustment member is accessible by a user's hand when the sanding apparatus is supported on the support stand, and an engaging member for engaging a motor speed adjustment member of the sanding apparatus to enable adjustment of the speed of the sanding belt of the sanding apparatus in response to actuation of the adjustment member, this provides the advantage of enabling the speed of movement of the sanding belt of the sander to be adjusted when in use. As a result, this significantly increases the degree of control of the amount of material removed by the sander when in an inverted orientation, which in turn increases the degree of precision with which the sander can be used.

The body portion may have at least one recess for receiving a respective part of said sanding apparatus.

The engaging member may be adapted to frictionally engage a belt speed adjustment member of the sanding apparatus.

The engaging member may be mounted to a shaft and adapted to rotate relative to said body portion.

The manually operable adjustment member may be a rotatable knob.

The engaging member may be co-axially mounted with the manually operable adjustment member.

The support stand may further comprise securing means for securing the sanding apparatus to the body portion.

The securing means may comprise at least one screw for engaging a respective threaded aperture on the sanding apparatus.

The support stand may further comprise retaining means for preventing removal of the or each said screw from the support stand.

The retaining means may comprise at least one O-ring mounted in use to a respective said screw.

The body portion may be substantially hollow.

BRIEF DESCRIPTION OF THE DRAWINGS

A preferred embodiment of the invention will now be described, by way of example only and not in any limitative sense, with reference to the accompanying drawings, in which.

DETAILED DESCRIPTION OF THE INVENTION

Figure 5:
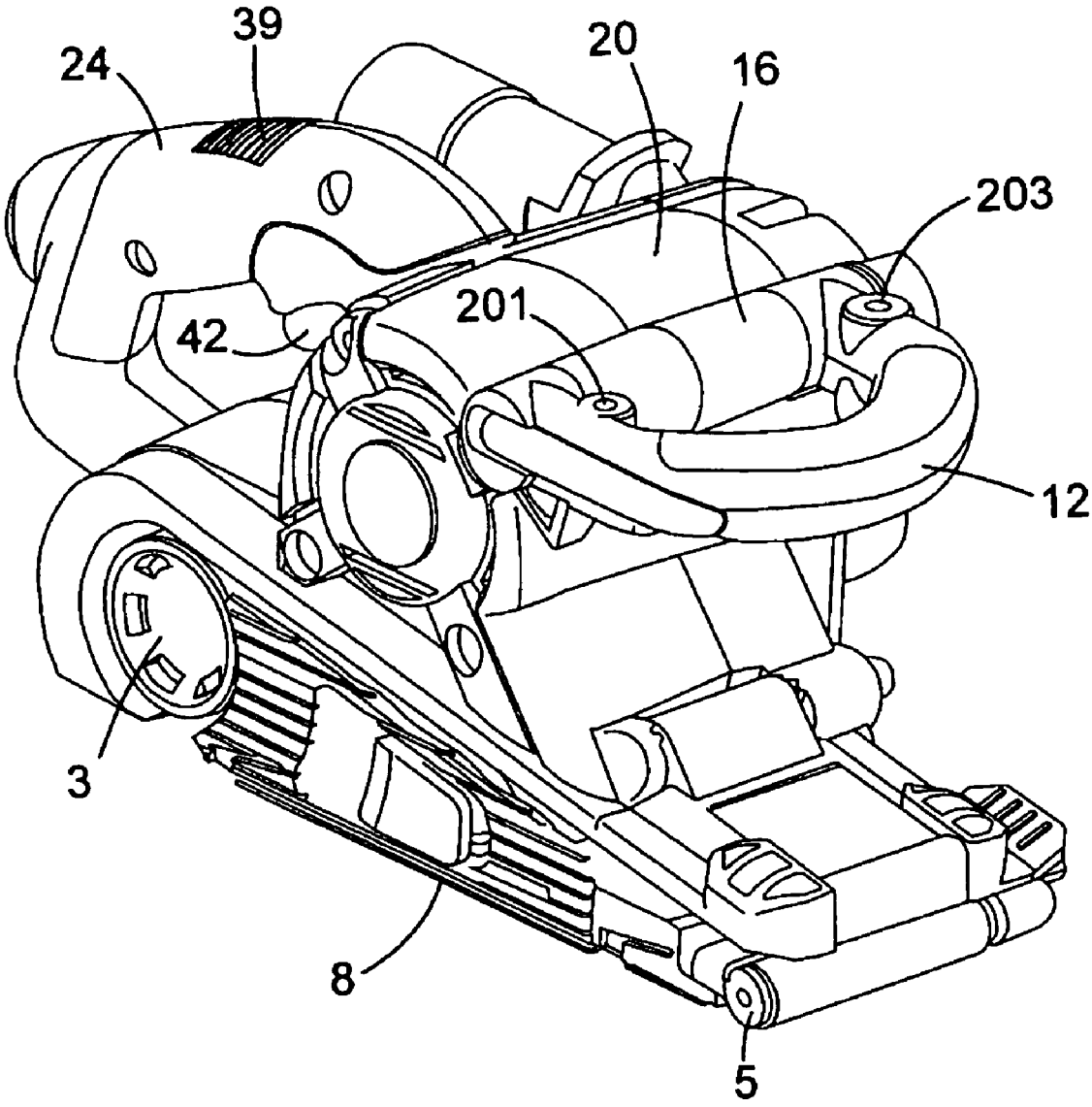
FIG. 5 is a perspective view of a belt sander for use with the support stand of FIGS. 1 to 4, and with the sanding belt of the sander removed.
Figure 6:
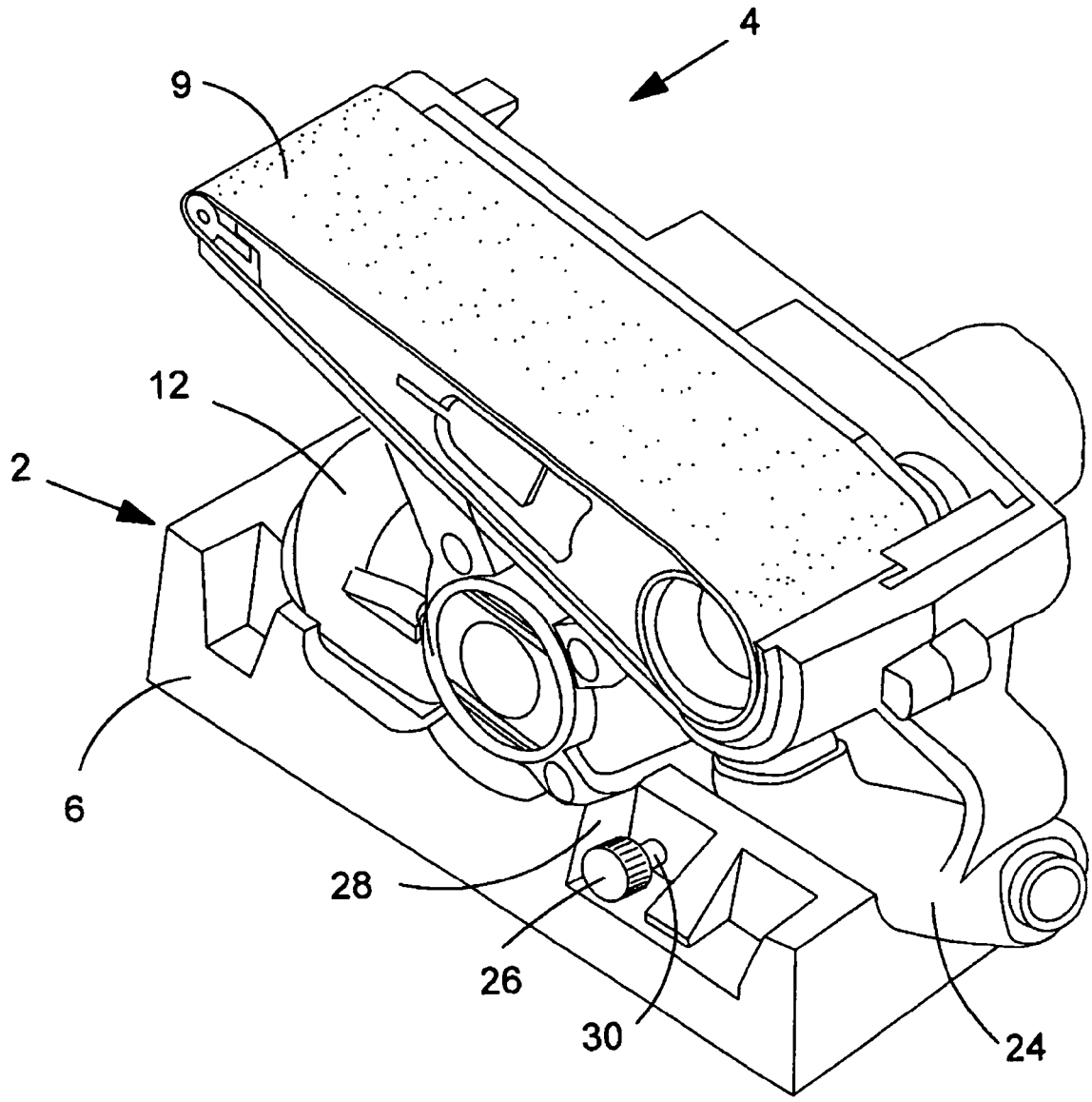
FIG. 6 is a perspective view of the belt sander of FIG. 5 mounted to the support stand of FIGS. 1 to 4 in an inverted orientation with the sanding belt of the sander in position.
Figure 7:
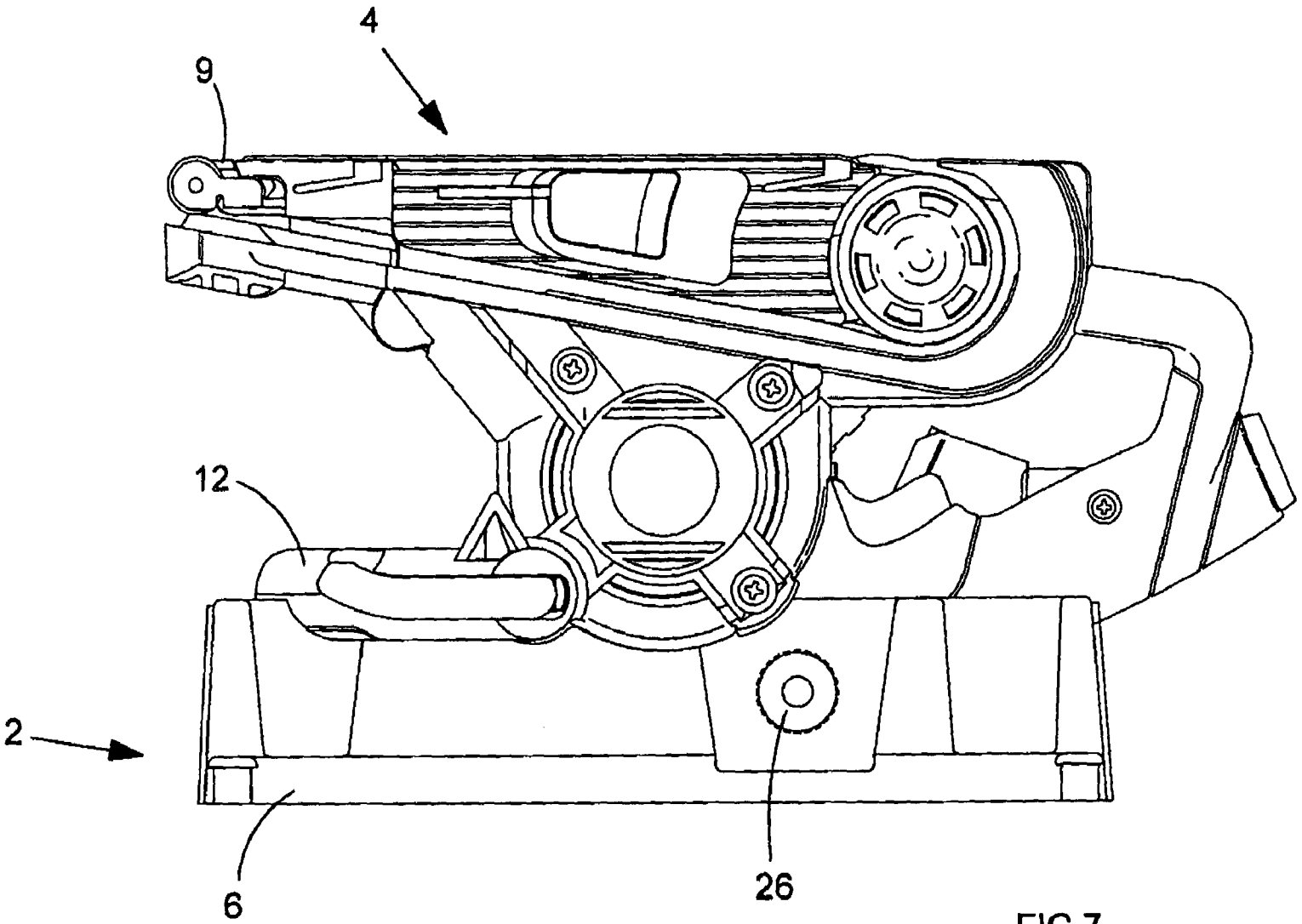
FIG. 7 is a side elevation view of the belt sander and support stand of FIG. 6.

Referring to FIGS. 1 to 4, a support stand 2 for a belt sander 4 (FIG. 5) for high stock removal sanding work has a generally hollow body portion 6 formed from durable plastics material such as ABS and having internal reinforcing ribs 8 (FIG. 4) and an upper surface shaped for receiving the belt sander 4 in an inverted orientation. By "inverted orientation" is meant that the parts of the belt sander 4 opposite to a base sanding surface 8 (FIG. 8) thereof are received on the upper surface of the body portion 6 so that when the sander 4 rests on the support stand 2, the sanding surface 8 faces upwards to enable a user to bring a work piece into contact with an endless sanding belt 9 (FIG. 6) passing over the sanding surface 8 and around driving roller 3 and driven roller 5 for precision sanding work.

Figure 1:
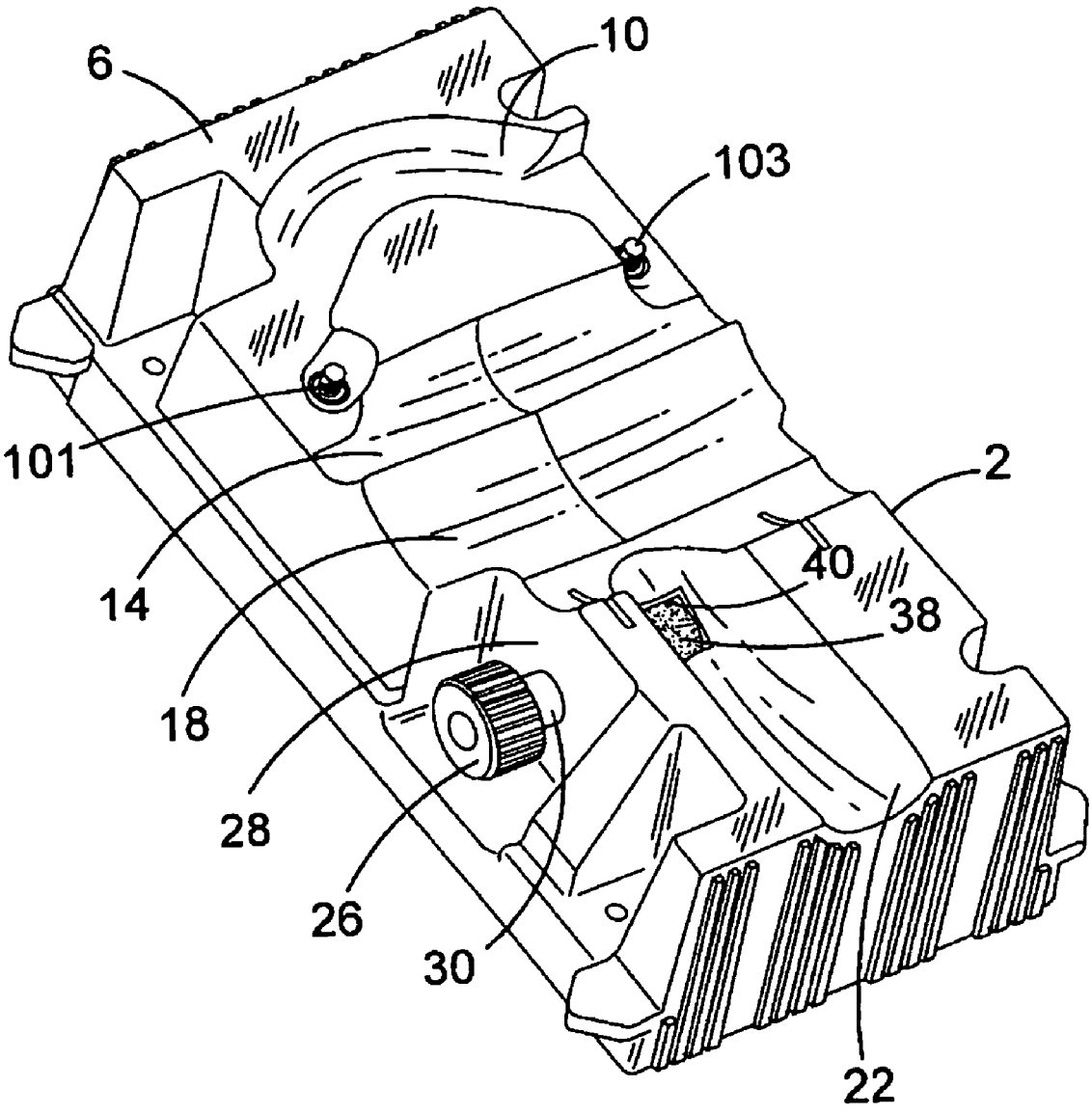
FIG. 1 is a perspective view of a belt sander support stand embodying the present invention.
Figure 2:
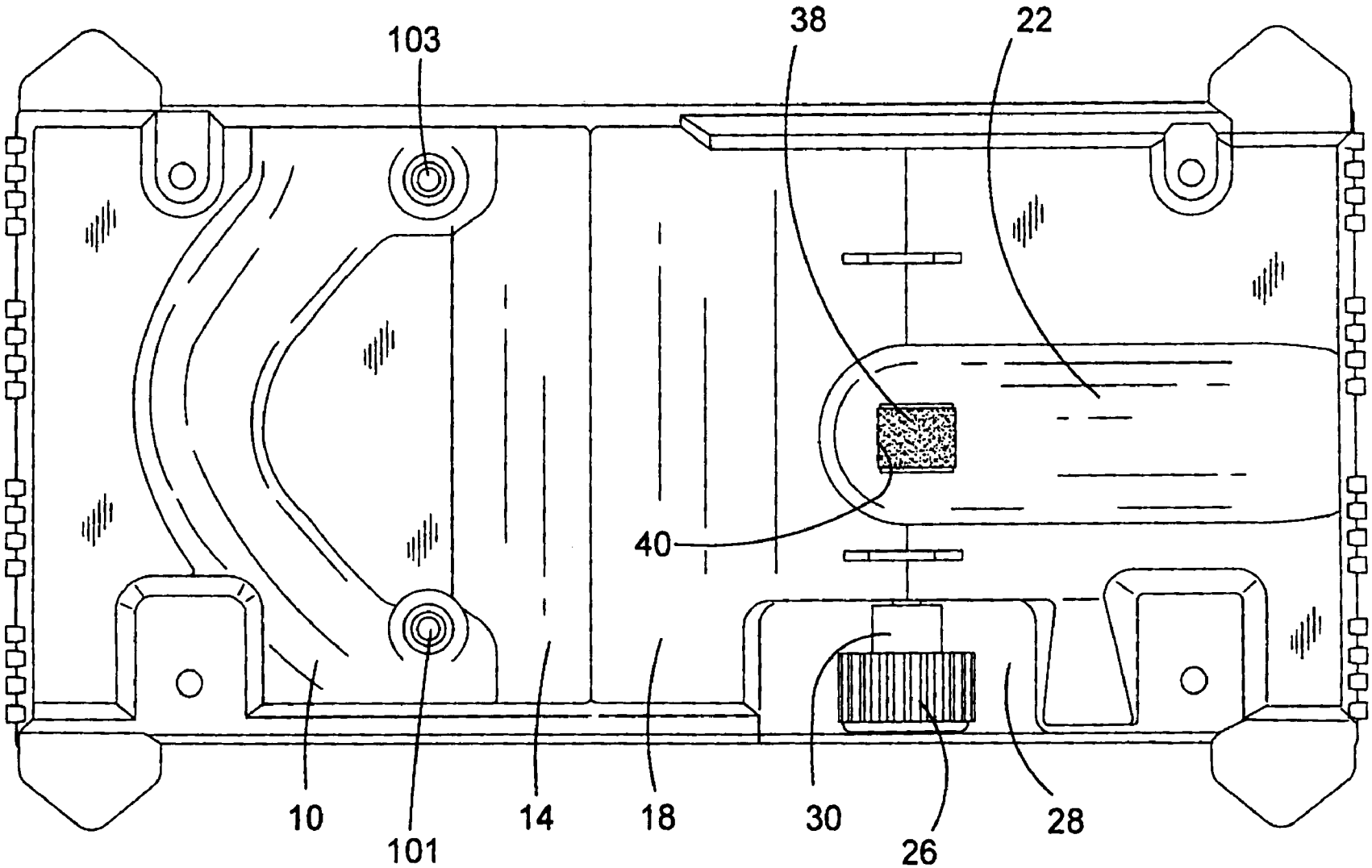
FIG. 2 is a view from above of the support stand of FIG. 1.
Figure 3:
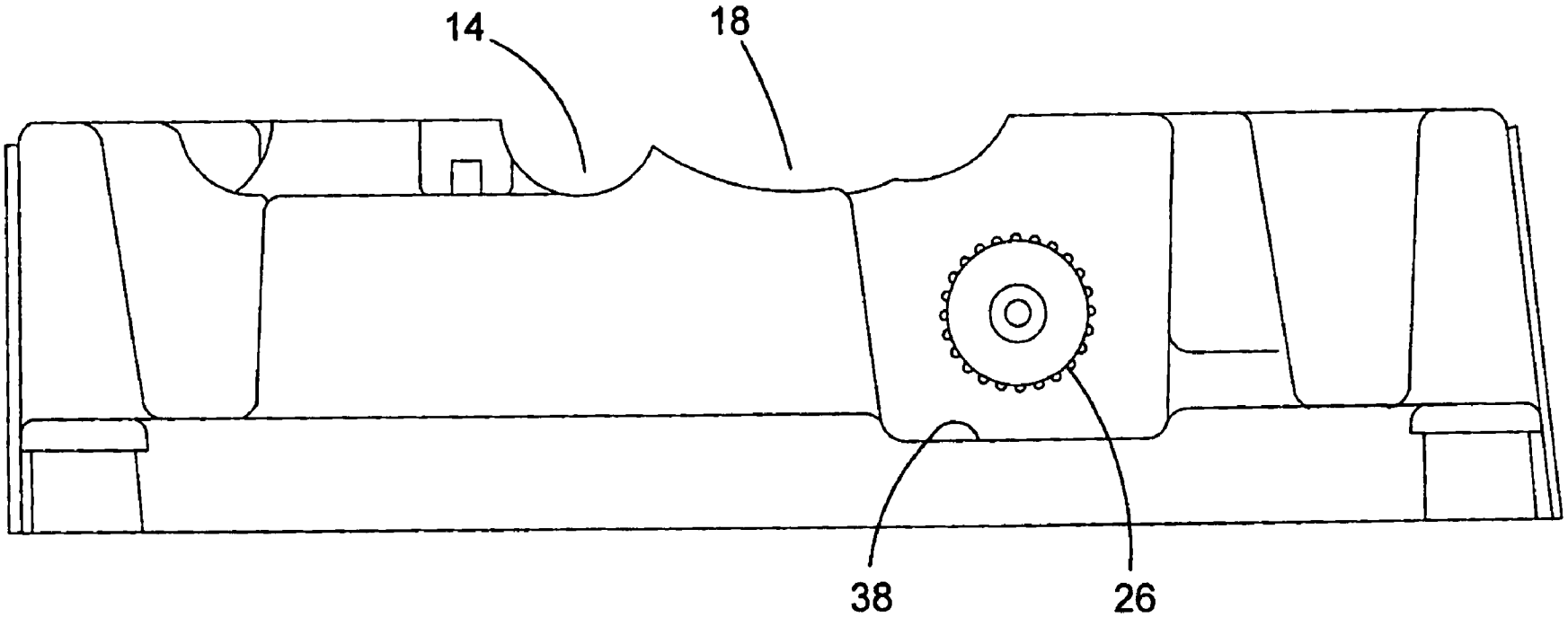
FIG. 3 is a side view of the support stand of FIG. 1.
Figure 4:
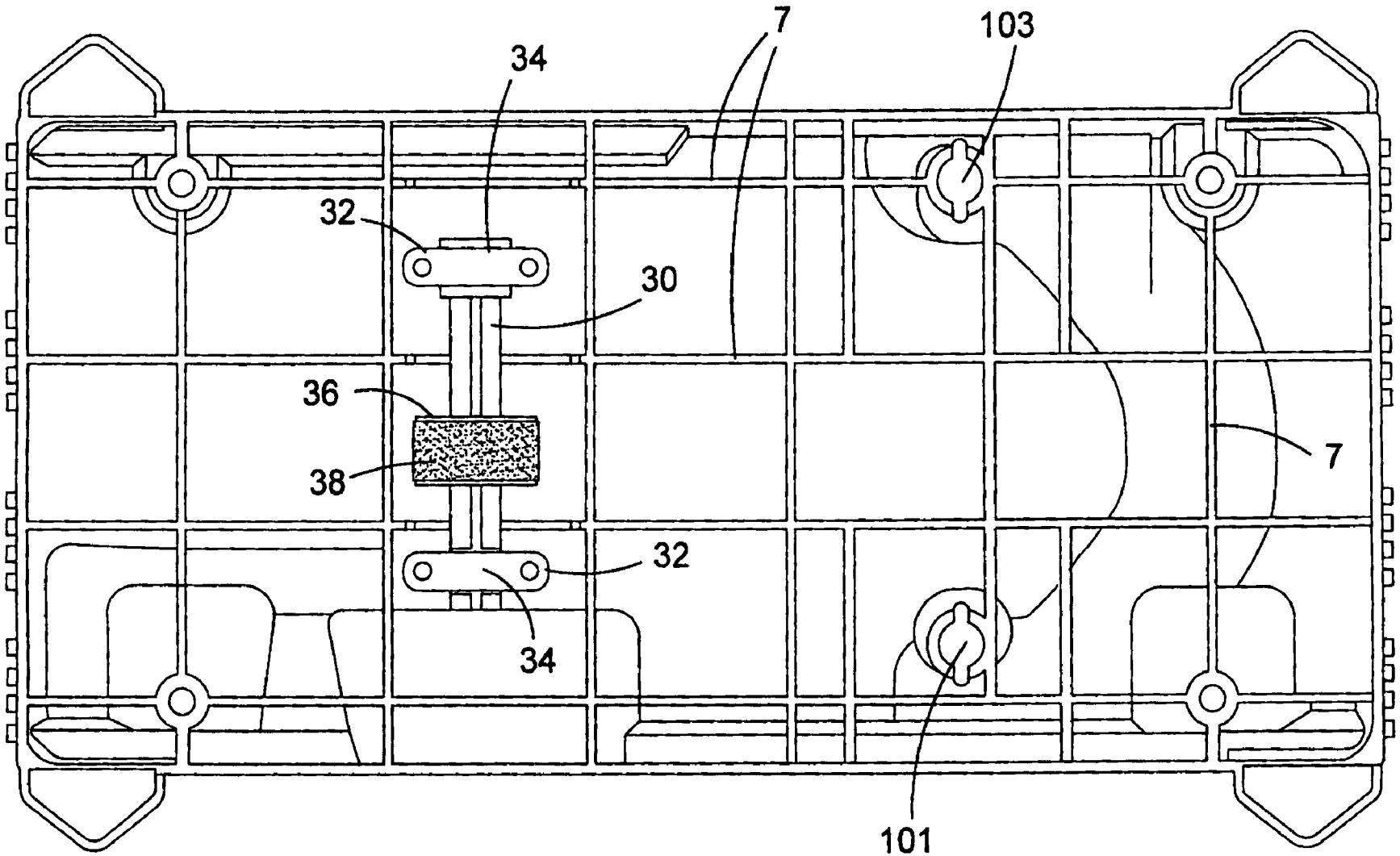
FIG. 4 is a bottom view of the support stand of FIG. 1.
Figure 8:
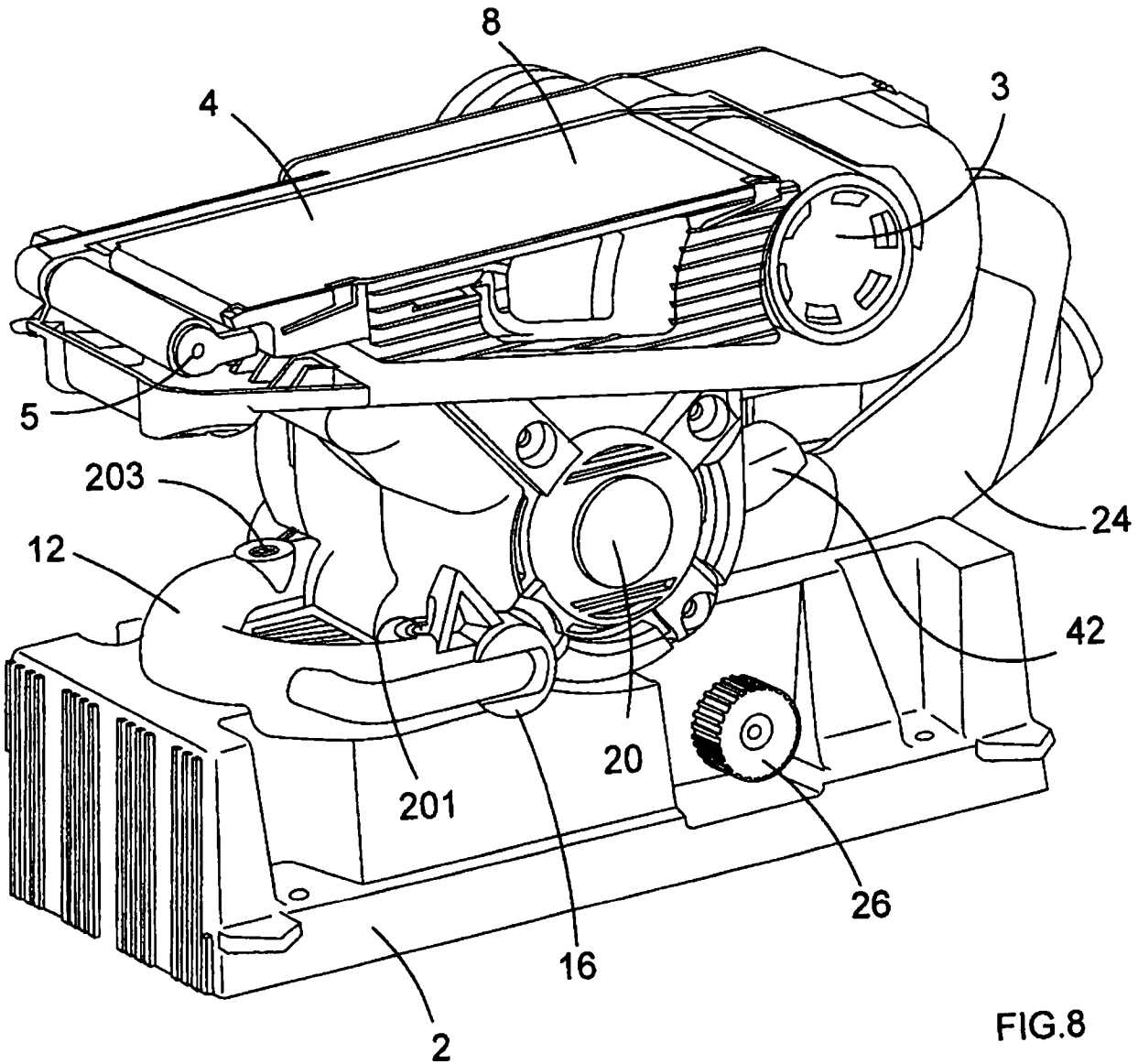
FIG. 8 is a perspective view of the support stand and sander of FIGS. 6 and 7 with the sanding belt of the sander removed.
Figure 9:
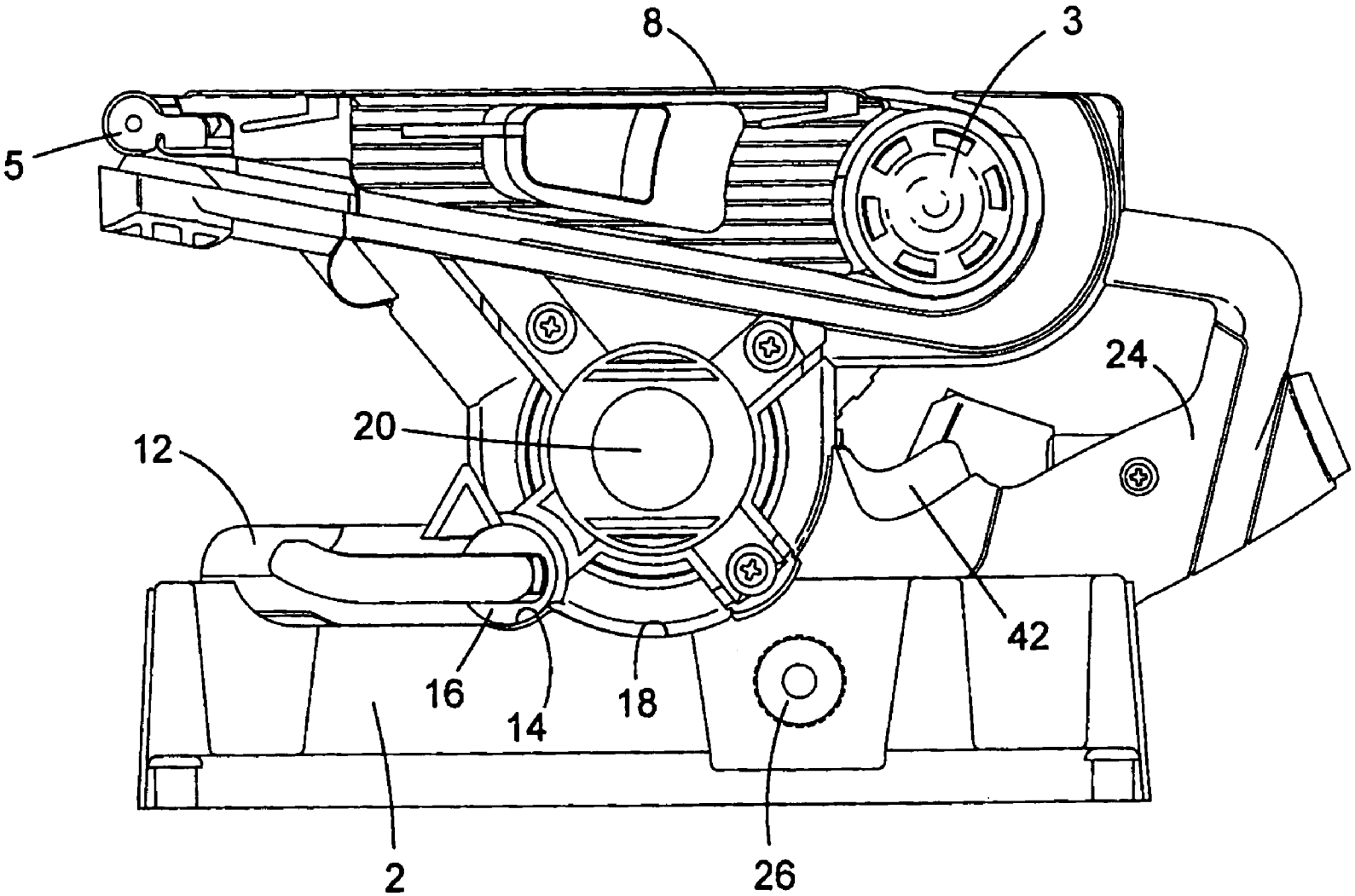
FIG. 9 is a side view of the support stand and belt sander of FIG. 8.
Figure 10:
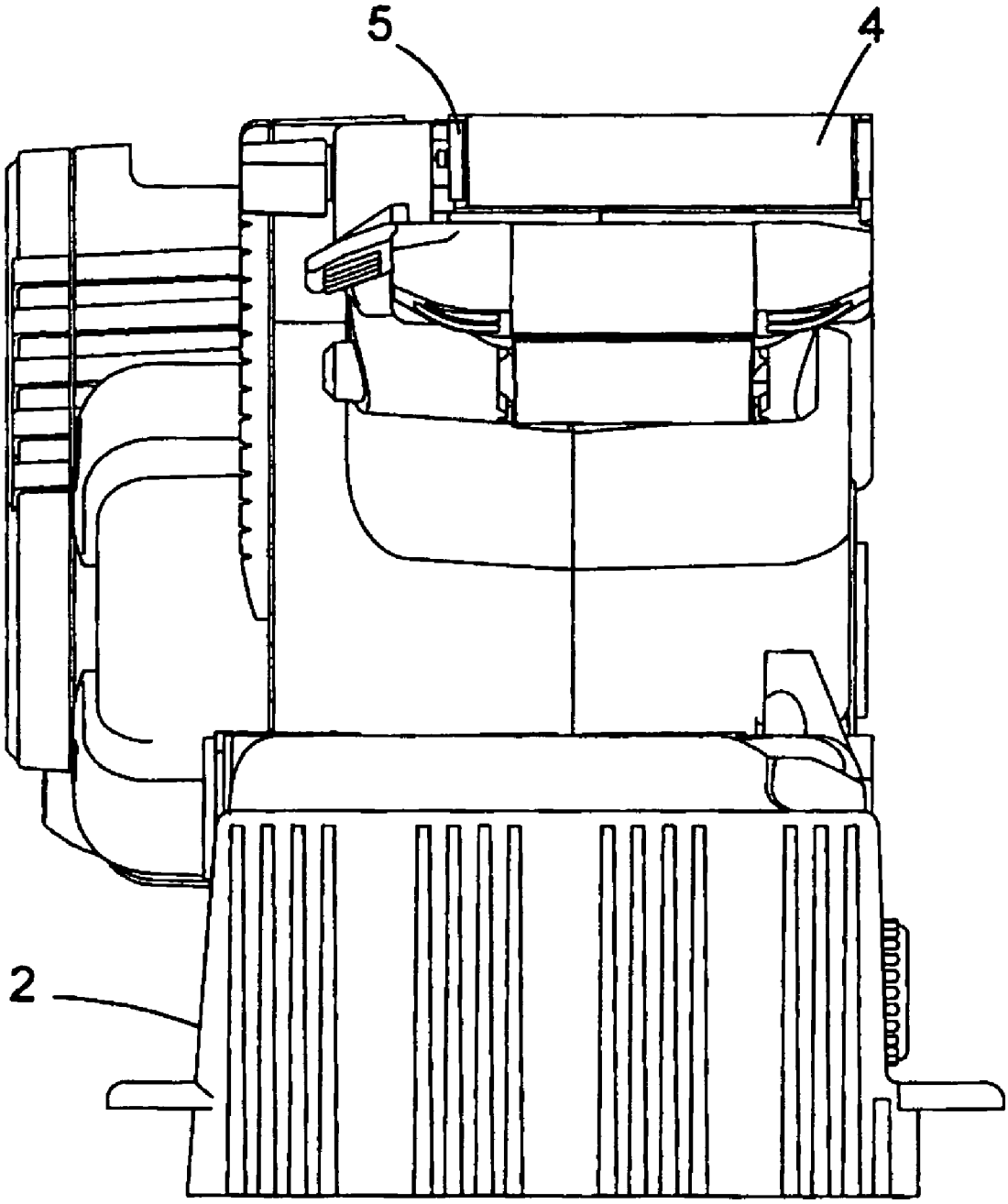
FIG. 10 is a front view of the support stand and belt sander of FIG. 8.
Figure 11:
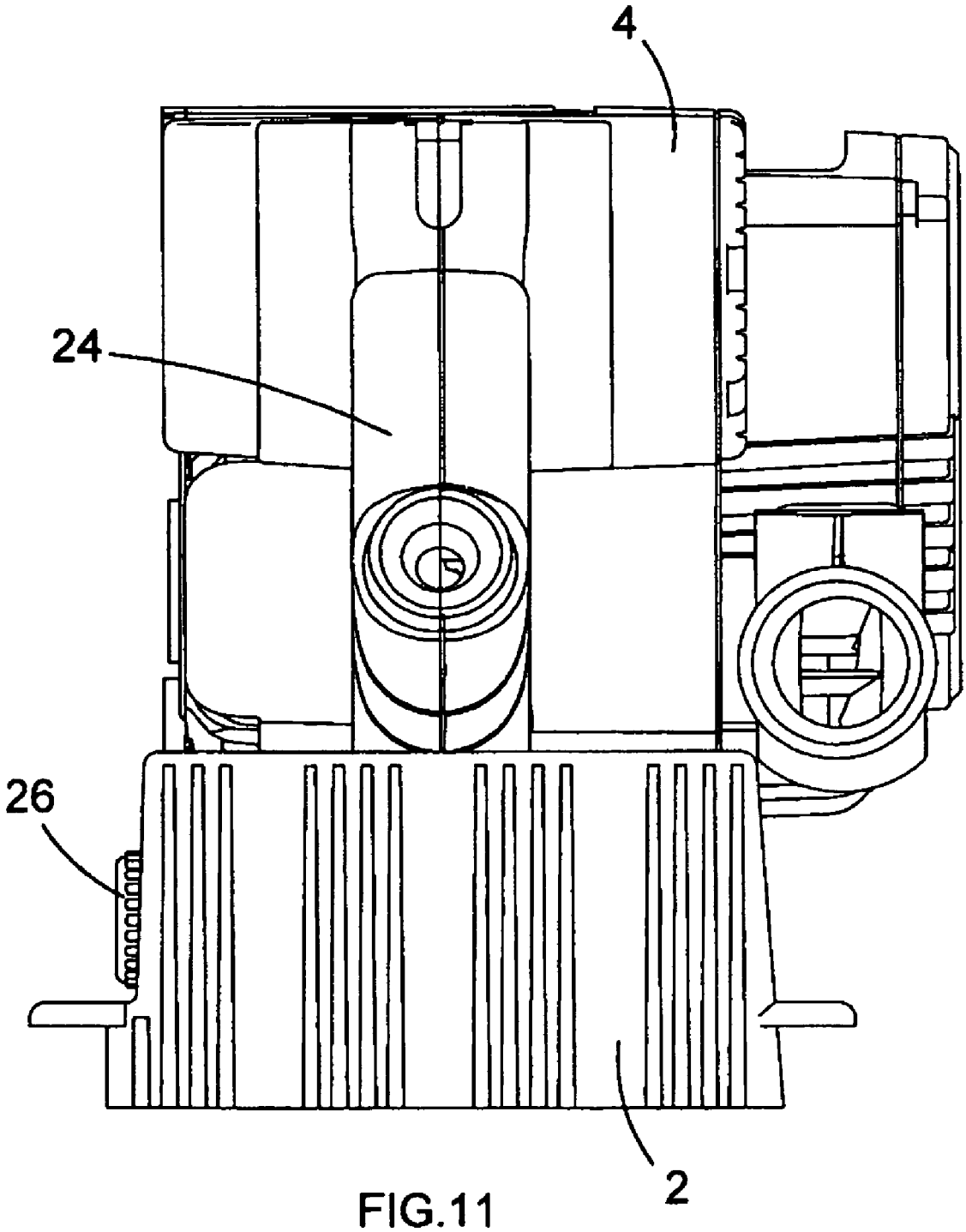
FIG. 11 is a rear view of the support stand and belt sander of FIG. 8.
Figure 12:
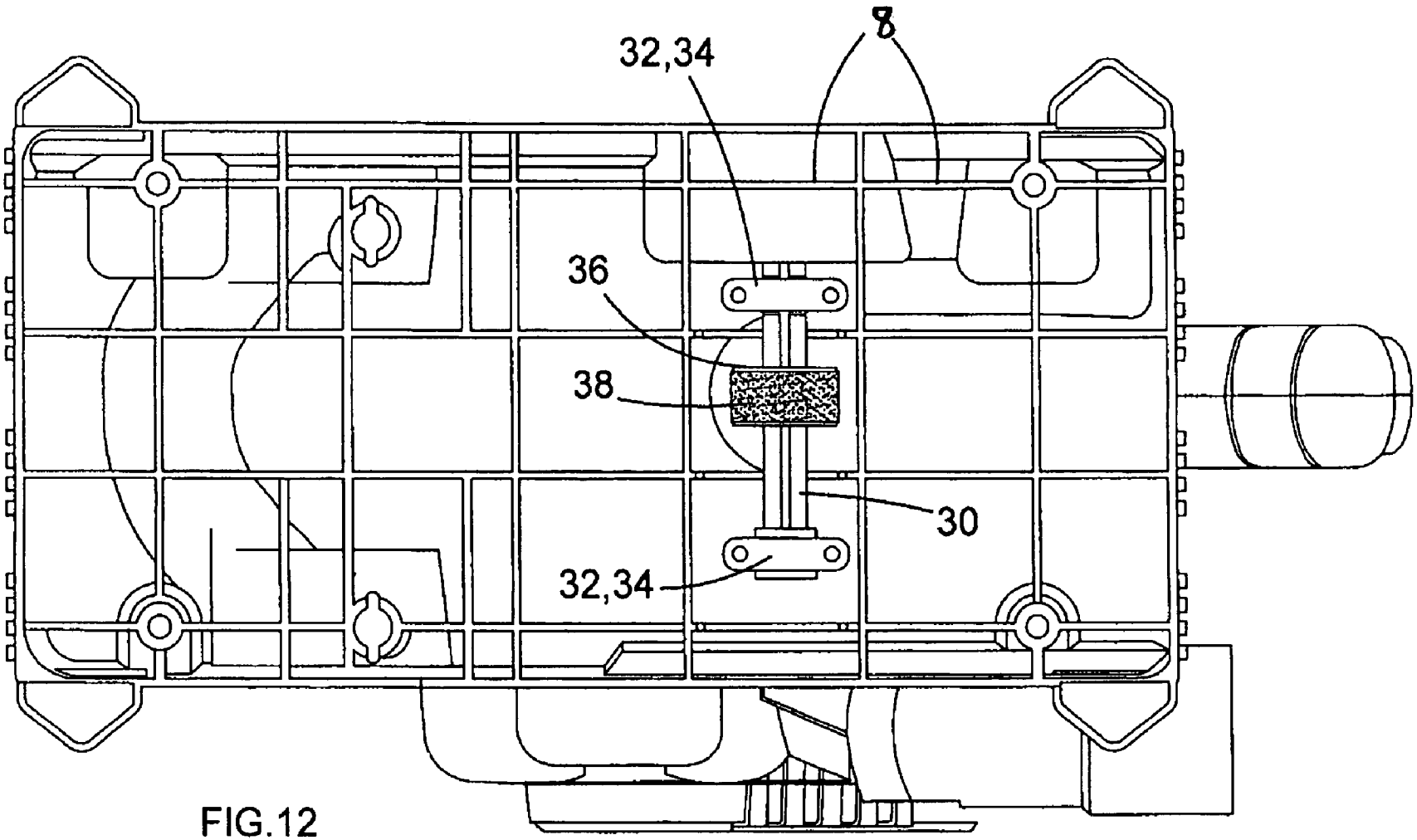
FIG. 12 is a bottom view of the support stand and belt sander of FIG. 8.

With particular reference to FIGS. 1 and 8, the body portion 6 of the support stand 2 is provided with an arc shaped recess 10 for receiving a forward handle 12 of the sander 4, a cylindrical transverse recess 14 for receiving a cylindrical pivot shaft 16 about which the handle 12 can pivot relative to a body of the sander 4, a transverse cylindrical recess 18 for receiving an upper part of a motor housing 20 of the sander 4, and a longitudinal recess 22 for receiving an upper part of a rear handle 24 of the sander 4. The forward handle 12 of the sander 4 is provided with brass inserts 201, 203 (FIG. 5), which are internally threaded to engage with clamping screws 101, 103 respectively (FIG. 1) on the support stand 2. The screws 101, 103 are each provided with an O-ring (not shown) of suitable material to prevent the screws 101, 103 from becoming separated from the support stand 2. Engagement of screws 101, 103 with inserts 201, 203 respectively enables the inverted sander 4 to be rigidly secured in position on the support stand 2 to prevent movement of the sander 4 during use.

A control knob 26 is provided in a recess 28 on a side part of body portion 6 so that the control knob 26 is accessible from the side of the support stand 2 by a user's hand when the sander 4 is in place in its inverted orientation on the support stand 2. The control knob 26 is mounted to the end of a rotatable shaft 30 which is mounted to supports 32 integral with body portion 6 by means of brackets 34. A wheel 36 carrying friction belt 38 is non-rotatably mounted to the shaft 30, and the diameter of wheel 36 is such that the friction belt 38 protrudes slightly from an aperture 40 in the body portion 6 to protrude slightly into recess 22. This enables friction belt 38 to come into contact with and frictionally engage a speed control knob 39 (FIG. 5) on the upper surface of upper handle 24 of sander 4, such that rotation of wheel 36 relative to the body portion 6 causes the speed control knob 39 of the sander 4 to rotate relative to the housing of the sander 4 to adjust the speed of the motor (not shown) and, hence, the speed of movement of the sanding belt 9 of sander 4.

The operation of the support stand 2 of FIGS. 1 to 4 will now be described with reference to FIGS. 6 to 12.

In order to carry out detailed sanding work on a workpiece (as opposed to large stock removal work such as sanding of a wooden floor), a user inverts the sander 4 from its normal orientation to the orientation shown in FIGS. 6 to 12, i.e. such that the forward handle 12, pivot shaft 16, upper surface of motor housing 20 and rear handle 24 are received in recesses 10, 14, 18, 22 respectively of the support stand 2. This brings the speed control knob 39 of the sander 4 into frictional contact with friction belt 38 on wheel 36 protruding through aperture 40 of body portion 6 of support stand 2.

The sander 4 is then clamped in position on the support stand 2 by means of engagement of the screws 101, 103 on the support stand 2 with the threaded apertures 201, 203 respectively on the forward handle 12 of the sander 4 to prevent the sander 4 from moving during use. The sander 4 is actuated by depressing a trigger 42 on rear handle 24 to cause the sanding belt 9 to move across sanding surface 8 at a speed determined by the setting of the speed control knob 39. The detailed operation of the sander 4 is not relevant to an understanding of the present invention and will therefore not be described in greater detail, but the sander 4 is provided with a lock-on trigger switch by means of which the sander 4 can be locked into its "on" condition after depression of trigger 42 so that the sanding belt 9 moves continuously without the need for further depression of the trigger 42.

In order to carry out detailed sanding work on a work piece (not shown), the user then brings the work piece into contact with the moving sanding belt 9 passing over sanding surface 8. If the user should then wish to adjust the speed of movement of the sanding belt 9 in order to control the rate of sanding of material from the work piece, the user can achieve this simply by rotating control knob 26, and there is no necessity to dismount the sander 4 from the support stand 2. This feature is therefore highly advantageous in that the belt sander 4 will typically be capable of very high rates of stock removal, as a result of which care must be taken not to remove excessive amounts of material when carrying out detailed sanding work on a work piece, and the rate of removal of material can be carefully and conveniently controlled, even when the sander 4 is in use and mounted to the support stand 2.

In the above example it has been disclosed how rotation of the control knob 26 causes concomitant rotation of the friction belt 38 and hence the motor speed control knob 39 of the sander 4 in order to control the speed of the sanding belt 9. Those skilled in the art, however, will appreciate that there is no necessity for the link between the control knob 26 and the sander motor speed control knob 39 to be a purely mechanical one. It will be understood that the mechanical link between these two items could be replaced by an electromechanical one, for example. The only necessity of operation here is that actuation of the control knob 26 by a user cause concomitant change in the motor speed for the sander 4 in order to correspondingly alter the speed of movement of the sanding belt 9.

It will be appreciated by persons skilled in the art that the above embodiment has been described by way of example only and not in any limitative sense, and that various alterations and modifications are possible without departure from the scope of the invention as defined by the appended claims.

The invention claimed is:

1. A support stand for a sanding apparatus, which sanding apparatus has a housing, a motor, and a plurality of rollers around which a sanding belt of abrasive material may be driven by means of said motor, the support stand comprising:

a body portion having a surface engaging a corresponding surface of the sanding apparatus in order to mount the sanding apparatus and to expose the sanding belt thereof;

a manually operable adjustment member mounted to said body portion and adapted to be accessible by a user when the sanding apparatus is mounted on the support stand; and an engaging member for engaging a motor speed adjustment member of the sanding apparatus to enable adjustment of the speed of the motor and, hence, the speed of the sanding belt of the sanding apparatus in response to actuation of the manually operable adjustment member.

2. The support stand recited in claim 1, wherein the surface of the body portion has at least one recess for receiving a respective protrusion of said sanding apparatus.

3. The support stand recited in claim 2, wherein the engaging member is adapted to frictionally engage a belt speed adjustment member of the sanding apparatus.

4. The support stand recited in claim 3, wherein the engaging member is mounted to a shaft and adapted to rotate relative to said body portion.

5. The support stand recited in claim 1, wherein the manually operable adjustment member is a rotatable knob.

6. The support stand recited in claim 5, wherein the engaging member is co-axially mounted with the manually operable adjustment member.

7. The support stand recited in claim 1, further comprising securing means for securing the sanding apparatus to the body portion.

8. The support stand recited in claim 7, wherein the securing means comprises at least one screw for engaging a respective threaded aperture on the sanding apparatus.

9. The support stand recited in claim 8, further comprising retaining means for preventing removal of said screw from the support stand.

10. The support stand recited in claim 9, wherein the retaining means comprises at least one O-ring mounted in use to a respective said screw.

11. The support stand recited in claim 1, wherein the body portion is substantially hollow.

12. The support stand recited in claim 1 said surface of said body portion comprising a plurality of recesses engaging a plurality of protrusions on the surface said sanding apparatus.

13. The support stand recited in claim 1, said surface of the body portion comprising at least one protrusion for receiving a respective recess of said sanding apparatus.

* * * * *